US012796812B2

(12) United States Patent
Lin et al.

(10) Patent No.: US 12,796,812 B2
(45) Date of Patent: Nov. 17, 2026

(54) SLIDING RAIL DEVICE

(71) Applicant: FOSITEK CORPORATION, New Taipei City (TW)

(72) Inventors: Chun-Han Lin, New Taipei City (TW); Che-Wei Chang, New Taipei City (TW); Jia-Wei Pan, New Taipei City (TW); Hao-Ping Wang, New Taipei City (TW)

(73) Assignee: FOSITEK CORPORATION, New Taipei City (TW)

( * ) Notice: Subject to any disclaimer, the term of this patent is extended or adjusted under 35 U.S.C. 154(b) by 142 days.

(21) Appl. No.: 18/428,564

(22) Filed: Jan. 31, 2024

(65) Prior Publication Data

US 2025/0151897 A1 May 15, 2025

(30) Foreign Application Priority Data

Nov. 14, 2023 (TW) ..... 112143800

(51) Int. Cl.
*A47B 88/423* (2017.01)

(52) U.S. Cl.
CPC ..... *A47B 88/423* (2017.01)

(58) Field of Classification Search
CPC ..... A47B 88/423; A47B 88/487
USPC ..... 312/330.1, 334.1
See application file for complete search history.

(56) References Cited

U.S. PATENT DOCUMENTS 4,696,582 A * 9/1987 Kasten ..... F16C 29/04 384/18
5,575,564 A * 11/1996 Harmon ..... B60N 2/06 384/34
6,379,045 B1 * 4/2002 Cirocco ..... A47B 88/493 312/334.11
6,860,574 B2 * 3/2005 Hwang ..... A47B 88/493 312/334.17

(Continued)

FOREIGN PATENT DOCUMENTS

TW 201740835 A 12/2017
TW 202143887 A 12/2021

OTHER PUBLICATIONS

Search Report appended to an Office Action, which was issued to Taiwanese counterpart application No. 112143800 by the TIPO on Apr. 18, 2024, with an English translation thereof.

*Primary Examiner* — Daniel J Troy
*Assistant Examiner* — Timothy M Ayres
(74) *Attorney, Agent, or Firm* — BURRIS LAW, PLLC

(57) ABSTRACT

A sliding rail device includes a first rail, a second rail and two supporting units. The first rail includes a first base wall and two first side walls cooperating with the first base wall to define a first passage. The first base wall has two engaging slots respectively adjacent to the first side walls. The second rail engages the first passage, is movable relative to the first rail, and includes a second base wall and two second side walls. The supporting units respectively and movably engage the engaging slots, and respectively and slidably abut against the first side walls and the second side walls. During movement of the second rail relative to the first rail, the supporting units are driven to respectively move along the engaging slots, and to move toward each other to tighten abutment of the supporting units against the second side walls.

4 Claims, 9 Drawing Sheets

(56) References Cited

U.S. PATENT DOCUMENTS

| | | | | |
|---|---|---|---|---|
| 7,025,430 | B2 * | 4/2006 | Lauchner | F16C 29/04 312/334.44 |
| 8,485,616 | B2 * | 7/2013 | Chen | A47B 88/493 312/333 |
| 9,279,451 | B2 * | 3/2016 | Judge | F16C 29/04 |
| 9,504,181 | B2 * | 11/2016 | Chen | F16B 7/10 |
| 11,140,983 | B2 * | 10/2021 | Chen | H05K 7/1489 |
| 11,213,124 | B2 * | 1/2022 | Chen | A47B 88/493 |
| 11,497,310 | B2 * | 11/2022 | Chen | A47B 88/423 |
| 12,251,016 | B2 * | 3/2025 | Yao | A47B 88/493 |
| 2002/0089273 | A1 * | 7/2002 | Weng | A47B 88/487 312/334.1 |

* cited by examiner

SLIDING RAIL DEVICE

CROSS-REFERENCE TO RELATED APPLICATION

This application claims priority to Taiwanese Invention Patent Application No. 112143800, filed on Nov. 14, 2023, the entire disclosure of which is incorporated by reference herein.

FIELD

The disclosure relates to a sliding rail device, and more particularly to a sliding rail device with supporting units.

BACKGROUND

A conventional supporting structure of a sliding rail device is fixed to a groove of a first rail, which prevents a second rail that engages the first rail from derailing. However, installing the supporting unit is not an easy task, and the supporting unit cannot fully and tightly abut against the second rail, causing the second rail to be unstable while moving relative to the first rail. Hence, there is room for improvement.

SUMMARY

Therefore, an object of the disclosure is to provide a sliding rail device that can alleviate at least one of the drawbacks of the prior art.

According to the disclosure, the sliding rail device includes a first rail, a second rail, and two supporting units. The first rail includes a first base wall and two first side walls. The two first side walls extend respectively and transversely from opposite sides of the first base wall, and cooperate with the first base wall to define a first passage. The first base wall has two engaging slots that are respectively adjacent to the first side walls and that are spaced apart from each other. The second rail engages the first passage, and is movable relative to the first rail. The second rail includes a second base wall and two second side walls. The two second side walls extend respectively and transversely from opposite sides of the second base wall. The two supporting units respectively and movably engage the engaging slots, and respectively and slidably abut against the first side walls and the second side walls. During movement of the second rail relative to the first rail, the supporting units are driven to respectively move along the engaging slots, and to move toward each other to tighten abutment of the supporting units against the second side walls.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
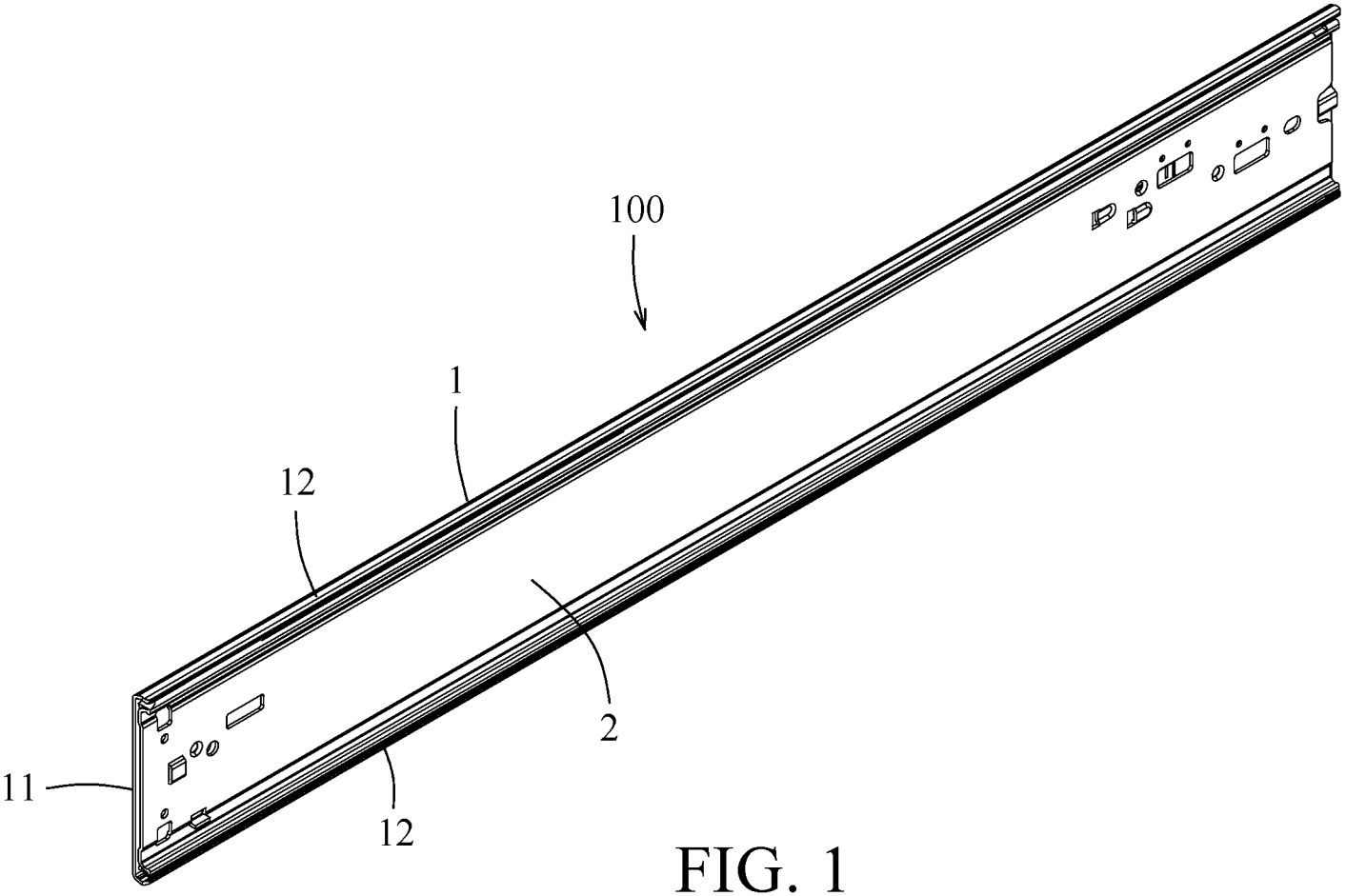
FIG. 1 is a perspective view of an embodiment of a sliding rail device according to the disclosure in a closed state.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
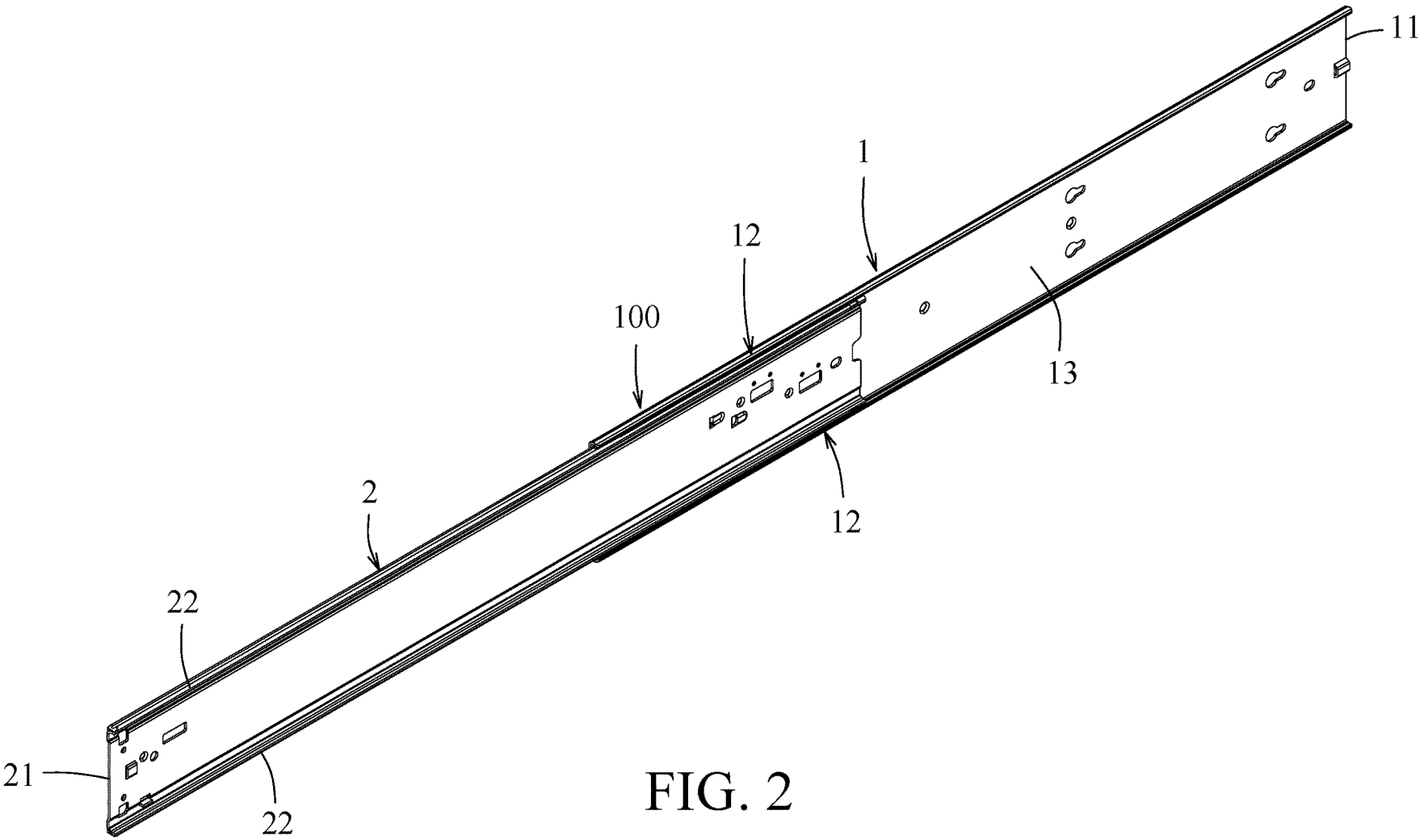
FIG. 2 is a perspective view of the embodiment in an opened state.
Figure 3:
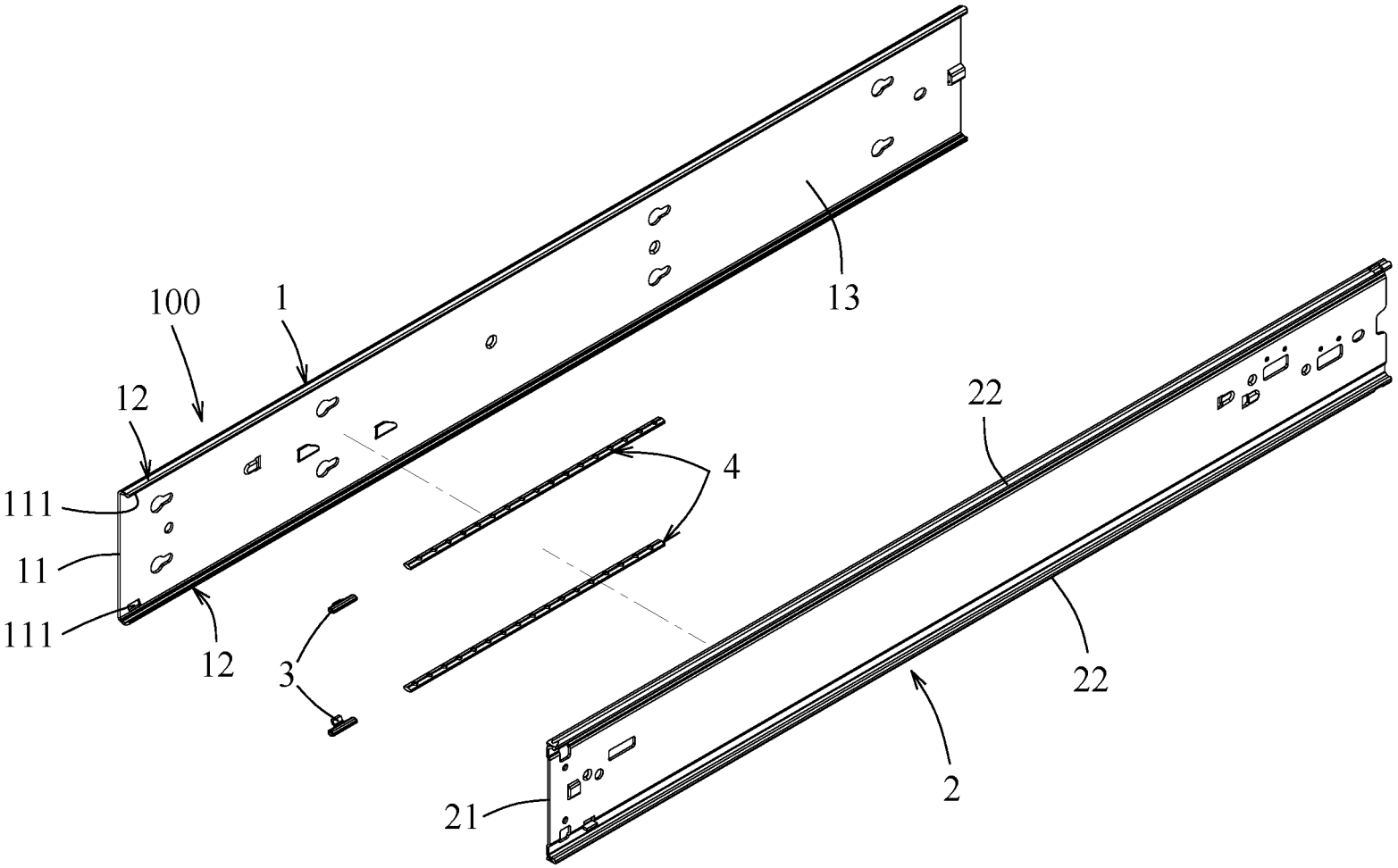
FIG. 3 is an exploded perspective view of the embodiment.

Referring to FIGS. 1 to 3, an embodiment of a sliding rail device 100 according to the disclosure includes a first rail 1, a second rail 2, two supporting units 3, and two ball bearing strips 4.

Figure 7:
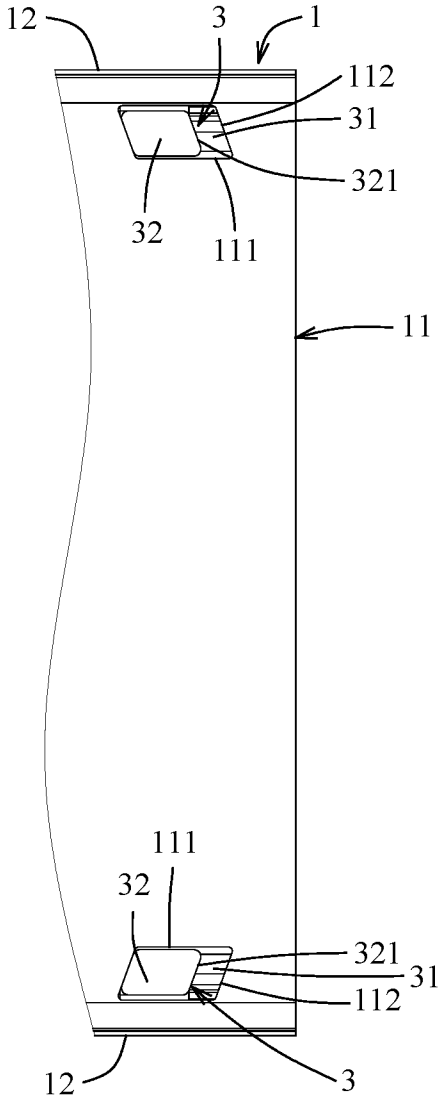
FIG. 7 is a fragmentary rear view of the embodiment, illustrating positions of two supporting units and two engaging slots when the embodiment is in the closed state.

The first rail 1 includes a first base wall 11, and two first side walls 12 extending respectively and transversely from opposite sides of the first base wall 11. The first side walls 12 cooperate with the first base wall 11 to define a first passage 13. The first base wall 11 has two engaging slots 111 that are respectively adjacent to the first side walls 12 and that are spaced apart from each other. The second rail 2 engages the first passage 13 and is movable relative to the first rail 1. The second rail 2 includes a second base wall 21, and two second side walls 22 extending respectively and transversely from opposite sides of the second base wall 21. Each of the engaging slots 111 has a parallelogrammatic shape, and is defined by a slot-defining surface that has a slope section 112. Referring further to FIG. 7, each of the slope sections 112 extends in a manner where the slope section 112 inclines in a direction from a respective one of the first side walls 12 toward a respective one of the second side walls 22 and is away from a respective one of the ball bearing strips 4.

Figure 4:
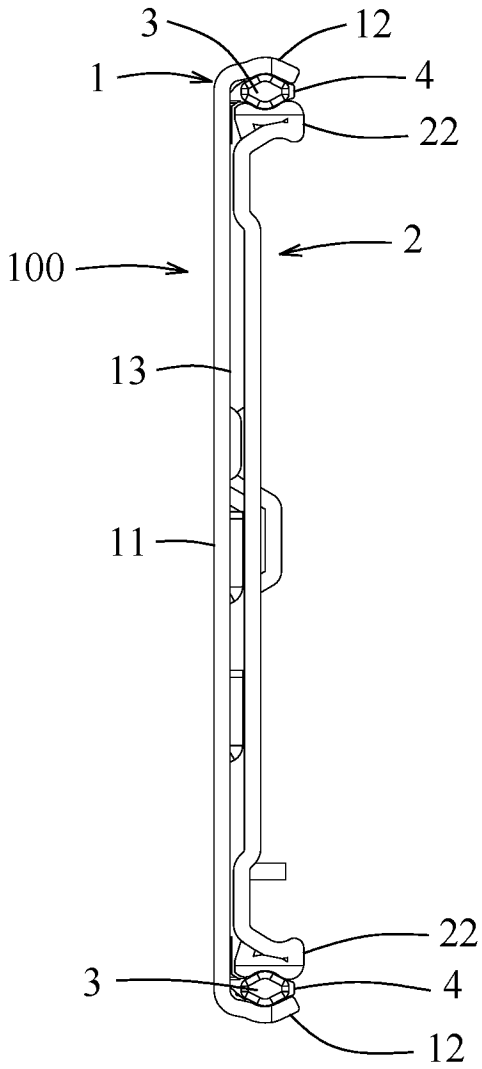
FIG. 4 is a side view of the embodiment.
Figure 5:
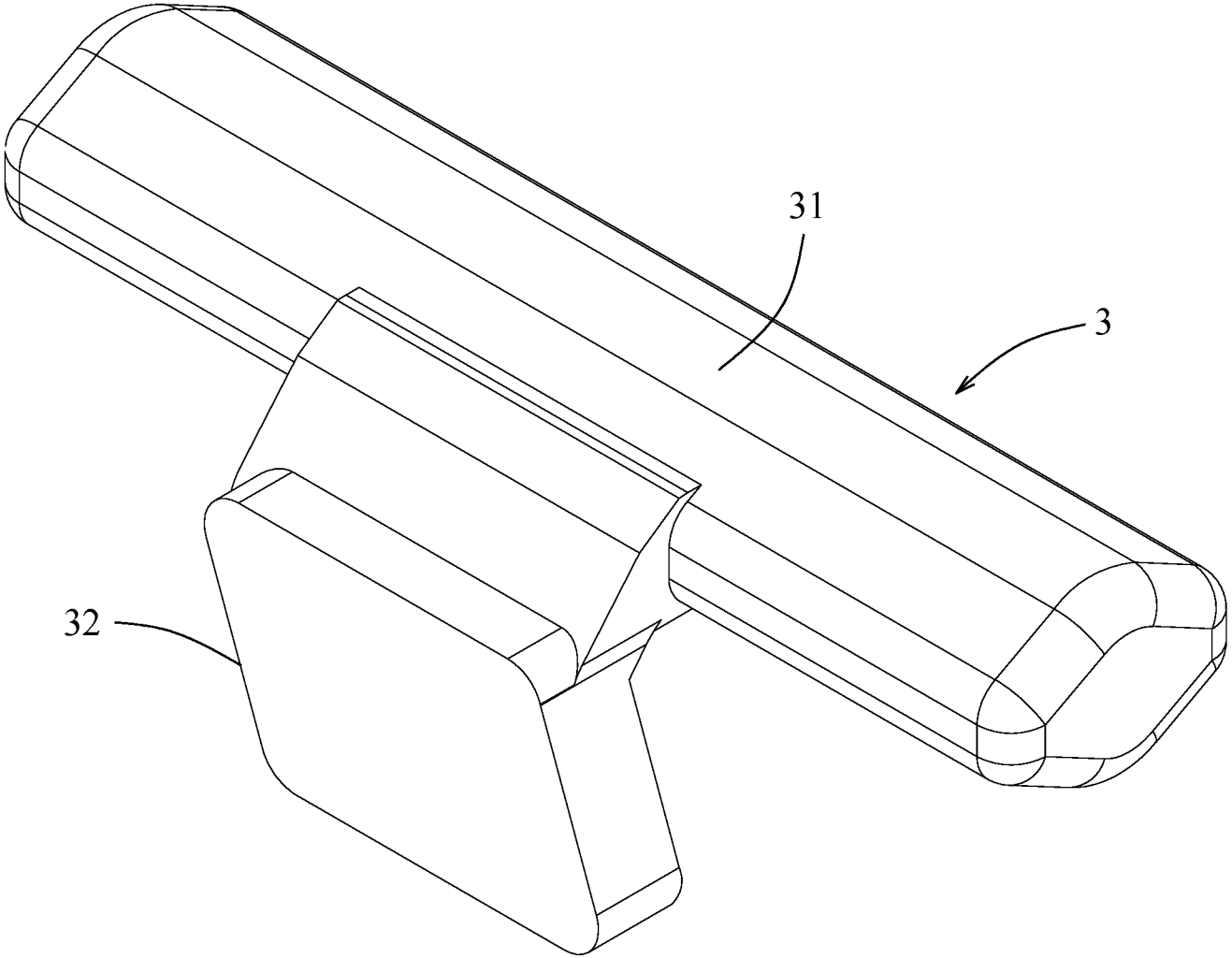
FIG. 5 is a perspective view of a supporting unit of the embodiment.
Figure 6:
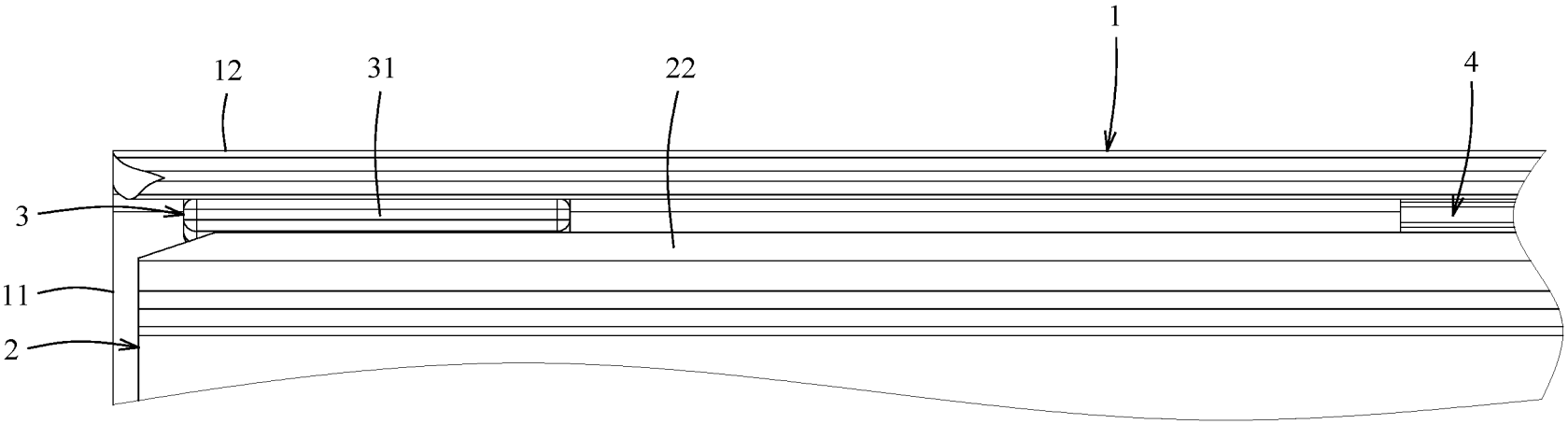
FIG. 6 is a fragmentary front view of the embodiment, illustrating positions of the supporting unit and a ball bearing strip when the embodiment is in the closed state.

Referring to FIGS. 4 to 6, the supporting units 3 respectively and movably engage the engaging slots 111, and respectively and slidably abut against the first side walls 12 and the second side walls 22. During movement of the second rail 2 relative to the first rail 1, the supporting units 3 are driven to respectively move along the engaging slots 111, and to move toward each other to tighten abutment of the supporting units 3 against the second side walls 22. Each of the supporting units 3 includes a main body 31 and an engaging block 32. The main body 31 extends in a lengthwise direction of the first rail 1, and abuts against a respective one of the first side walls 12 and the respective one of the second side walls 22. The engaging block 32 extends from the main body 31 into a respective one of the engaging slots 111, and has an engaging slope 321 (see FIG. 7) that faces the slope section 112 of the slot-defining surface defining the respective one of the engaging slots 111. A portion of the engaging block 32 of each of the supporting units 3 disposed within the respective one of the engaging slots 111 has a parallelogrammatic shape. During the movement of the second rail 2 relative to the first rail 1, the supporting units 3 are driven to respectively move along the engaging slots 111 to respectively abut the engaging slopes 321 of the engaging blocks 32 of the supporting units 3 against the slope sections 112 of the slot-defining surfaces, so that the supporting units 3 are driven to move toward each other to tighten the abutment of the supporting units 3 against the second side walls 22. Each of the ball bearing strips 4 is movably disposed on the respective one of the first side walls 12 and abuts against the respective one of the second side walls 22.

Figure 8:
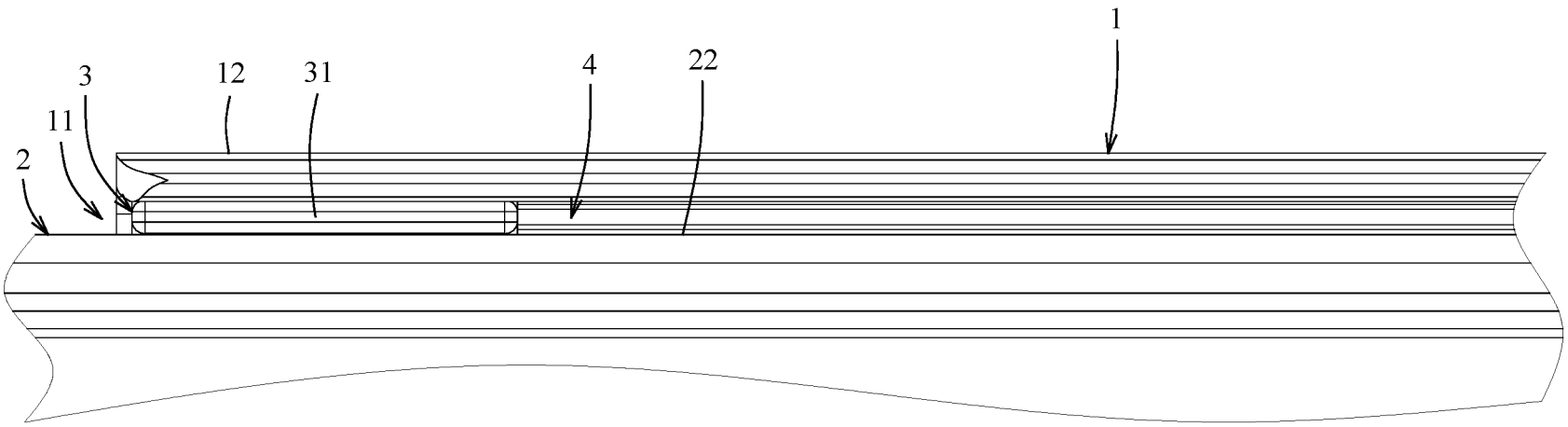
FIG. 8 is a fragmentary front view of the embodiment, illustrating positions of the supporting unit and the ball bearing strip when the embodiment is in the opened state.
Figure 9:
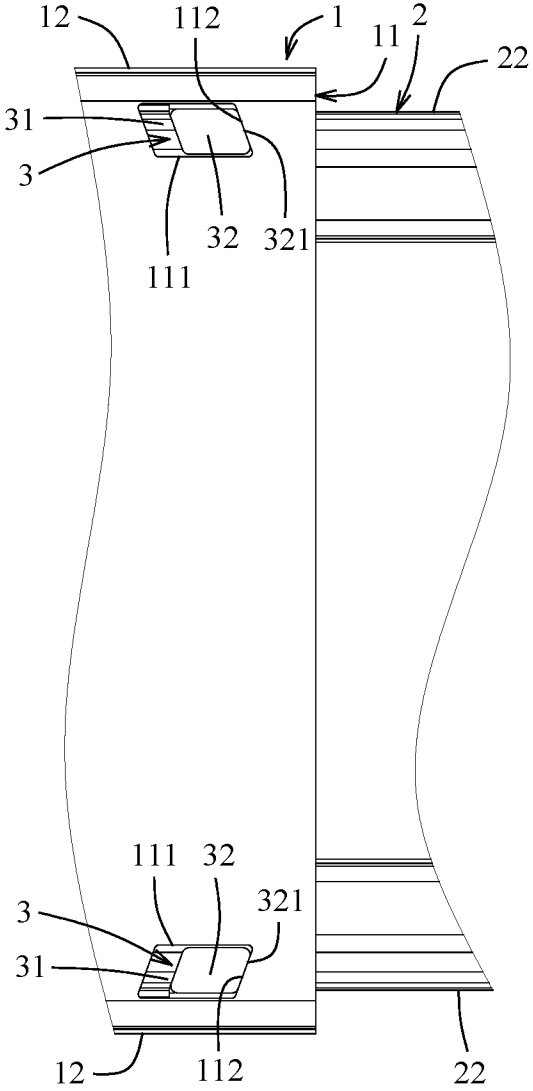
FIG. 9 is a fragmentary rear view of the embodiment, illustrating positions of the two supporting members and the two engaging slots when the embodiment is in the opened state.

Referring to FIGS. 1 and 2, the sliding rail device 100 may switch between a closed state and an opened state. When the sliding rail device 100 is in the closed state, the second rail 2 substantially overlaps with the first rail 1 (see FIG. 1), the engaging slope 321 of each of the supporting units 3 is spaced apart from the slope section 112 of the respective one of the slot-defining surfaces (see FIGS. 6 and 7), and each of the ball bearing strips 4 is spaced apart from a respective one of the supporting units 3 (see FIG. 6). Further referring to FIGS. 8 and 9, when the sliding rail device 100 converts to the closed state, the second rail 2 is moved relative to the first rail 1, and the ball bearing strips 4 are moved together with the second rail 2 and respectively abut against the supporting units 3, driving the supporting units 3 to respectively move along the engaging slots 111 so as to respectively abut the engaging slopes 321 of the engaging blocks 32 of the supporting units 3 against the slope sections 112 of the slot-defining surfaces, and generating a reaction force that has a component force in a direction from the respective one of the first side walls 12 to the respective one of the second side walls 22. The component force drives the supporting units 3 to move toward each other so as to tighten the abutment of the supporting units 3 against the second side walls 22, and the reaction force creates a torque that drives the supporting units 3 to rotate and tighten the abutment of the supporting units 3 against the first side walls 12, reducing shaking and rotating of the second rail 2 when the second rail 2 is moved relative to the first rail 1, and thereby allowing the second rail 2 to stably move relative to the first rail 1, and not to be easily affected by external forces during movement.

In conclusion, the supporting units 3 of the sliding rail device 100 respectively and movably engage the engaging slots 111, and respectively and slidably abut against the first side walls 12 and the second side walls 22. Furthermore, when the second rail 2 is moved relative to the first rail 1, the reaction force generated from abutting the engaging slopes 321 of the engaging blocks 32 of the supporting units 3 against the slope sections 112 of the slot-defining surfaces drives the supporting units 3 to move toward each other and to respectively and tightly abut against the second side walls 22, so that the second rail 2 may steadily move relative to the first rail 1, thereby achieving the objective of the disclosure.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A sliding rail device comprising:

a first rail that includes a first base wall, and two first side walls extending respectively and transversely from opposite sides of said first base wall, and cooperating with said first base wall to define a first passage, said first base wall having two engaging slots that are respectively adjacent to said first side walls and that are spaced apart from each other;

a second rail that engages said first passage, that is movable relative to said first rail, and that includes a second base wall, and two second side walls extending respectively and transversely from opposite sides of said second base wall; and two supporting units that respectively and movably engage said engaging slots, and that respectively and slidably abut against said first side walls and said second side walls;

wherein, during movement of said second rail relative to said first rail, said supporting units are driven to respectively move along said engaging slots, and to move toward each other to tighten abutment of said supporting units against said second side walls.

2. The sliding rail device as claimed in claim 1, wherein:

said sliding rail device further comprises two ball bearing strips, each of said ball bearing strips being movably disposed on a respective one of said first side walls and abuts against a respective one of said second side walls;

each of said engaging slots is defined by a slot-defining surface having a slope section, said slope section extending in a manner where said slope section inclines in a direction from a respective one of said first side walls toward a respective one of said second side walls and is away from a respective one of said ball bearing strips;

each of said supporting units includes a main body extending in a lengthwise direction of said first rail, and abutting against a respective one of said first side walls and a respective one of said second side walls, and an engaging block extending from said main body into a respective one of said engaging slots, and having an engaging slope that faces said slope section of said slot-defining surface defining the respective one of said engaging slots, and that inclines in a direction from a respective one of said first side walls toward a respective one of said second side walls and is away from a respective one of said ball bearing strips; and during the movement of said second rail relative to said first rail, said supporting units are driven to respectively move along said engaging slots to respectively abut said engaging slopes of said engaging blocks of said supporting units against said slope sections of said slot-defining surfaces, so that said supporting units are driven to move toward each other to tighten the abutment of said supporting units against said second side walls.

3. The sliding rail device as claimed in claim 2, wherein each of said engaging slots has a parallelogrammatic shape.

4. The sliding rail device as claimed in claim 3, wherein a portion of said engaging block of each of said supporting units disposed within the respective one of said engaging slots has a parallelogrammatic shape.

* * * * *